United States Patent [19]

Garner

[11] 4,206,568

[45] Jun. 10, 1980

[54] JOINED DOLLS

[76] Inventor: Janet S. Garner, 1306 Delmar, Midland, Tex. 79701

[21] Appl. No.: 904,160

[22] Filed: May 9, 1978

Related U.S. Application Data

[63] Continuation of Ser. No. 710,692, Aug. 2, 1976, abandoned.

[51] Int. Cl.[2] ..... A63H 3/12

[52] U.S. Cl. ..... 46/153; 46/159

[58] Field of Search ..... 46/153, 159, 158, 157, 46/151, 87, 162, 163, 161

[56] References Cited

U.S. PATENT DOCUMENTS

| | | | |
|---|---|---|---|
| 1,336,898 | 4/1920 | Flynn | 46/151 |
| 1,753,032 | 4/1930 | Stein et al. | 46/116 |
| 2,754,121 | 7/1956 | Jupiter | 46/151 |

FOREIGN PATENT DOCUMENTS

| | | | |
|---|---|---|---|
| 523823 | 4/1956 | Canada | 46/115 |

*Primary Examiner*—Louis G. Mancene
*Assistant Examiner*—Mickey Yu
*Attorney, Agent, or Firm*—Marcus L. Bates

[57] ABSTRACT

A plurality of dolls are joined together in face to face relationship by attaching the extremities thereof together. The extremities are bendable to permit relative movement between each of the joined dolls. In one embodiment of the invention, the dolls are joined together in a manner to form a joint at the contiguous areas between the two dolls. In another embodiment of the invention, the legs and arms are sewn to one another and to the torso of each doll, to provide a joint at the location where each of the members are interconnected.

4 Claims, 12 Drawing Figures

JOINED DOLLS

This is a continuation of application Ser. No. 710,692, filed Aug. 2, 1976, now abandoned.

BACKGROUND OF THE INVENTION

Once upon a time, a long time ago, the vast majority of little girls played with homemade dolls. This was so because our society was not affluent, nor were the manufacturing techniques of doll fabrication substantially advanced to provide the authentic, lifelike dolls presently available on the market.

However, times have changed, and the playing with dolls is no longer limited to little girls nor to the less affluent members of our society. Many grownups nowadays take great pleasure in fabricating all sorts of very cleverly constructed dolls, while children usually are forced to play with the less desirable, authentic, lifelike dolls which are usually purchased at the department store.

It is therefore desirable to provide children and grownups with a unique rag doll which is simple to fabricate, low in cost, and which furthermore offers the additional advantage of providing continuous entertainment in a manner not found in the rag dolls of the prior art.

It is furthermore desirable to provide a unique doll which is made of modern plastic or rubber-like material, and which has many of the aforesaid attributes.

SUMMARY OF THE INVENTION

This invention comprises two immediate facing dolls joined together at each extremity thereof. The legs and arms are bendable respective to one another and to the torso.

More specifically, the present invention is comprised of a pair of dolls, each having a torso, head, arms, and legs. The arms and legs are joined together and to the torso in a manner to provide relative movement between the two torsos.

In one embodiment of the invention, the dolls are of unitary construction with there being no joint where the arms and legs are affixed to one another and to the torso.

In another embodiment of the invention, the arms and legs are sewn to one another and to the torso in a manner to provide a joint at the juncture where the arms and legs are connected and at the juncture where the arms and legs are affixed to the torso. This last expedient provides an articulated pair of arms and an articulated pair of legs for each doll of the pair of dolls.

The extremities of the legs and arms of each doll are interconnected to provide a joint between the interconnected legs and the interconnected arms. The interconnection of the legs and arms preferably is attained by sewing or stitching.

The immediacy of the dolls, together with the articulated extremities, enable the dolls to be placed into an infinite number of different configurations, some of which are comical, some of which are humorous, and some of which are sad. Perhaps there are other configurations yet to be discovered.

A primary object of the present invention is the provision of a pair of dolls which can be easily arranged in a number of different configurations.

Another object of the invention is to provide a pair of dolls which are joined together at the extremities and arranged to have articulated arms and legs.

A further object of this invention is to disclose and provide a pair of dolls which are joined together at the extremities in face-to-face relationship, and which have limbs which enable relative movement therebetween to be achieved.

A still further object of this invention is the provision of a plurality of rag dolls joined together at the extremities by stitching, and having articulated arms and legs which enable the dolls to be arranged in a number of different relative positions.

Another and still further object of this invention is to disclose and provide a multiplicity of dolls having arms and legs, and which are placed in face-to-face relationship and joined together at the extremities to provide for movement therebetween.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Throughout the various figures of the drawings, like or similar numerals will refer to like or similar elements or objects. In the various figures of the drawings there is disclosed two facing, immediate dolls joined together at each extremity and having movable or bendable legs and arms. The legs and arms are also movable or bendable at the contiguous areas formed at the extremities.

Figure 1:
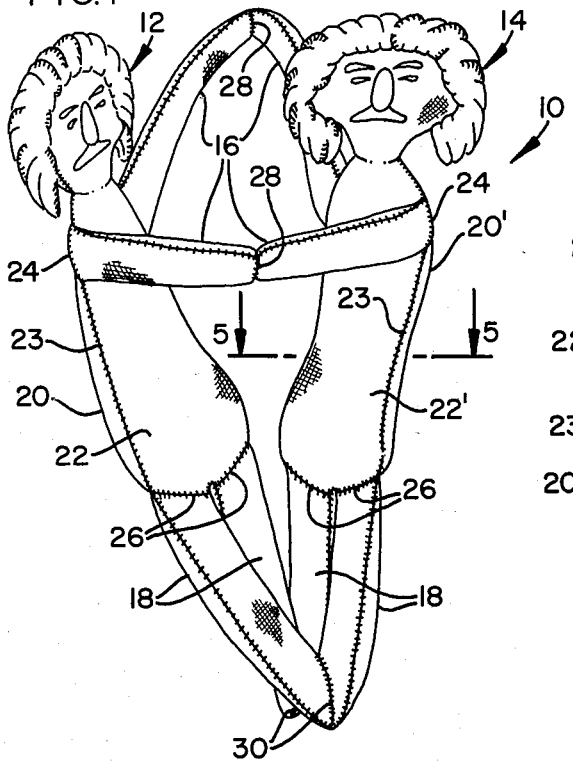
FIG. 1 is a perspective view of a pair of rag dolls made in accordance with the present invention.
Figure 3:
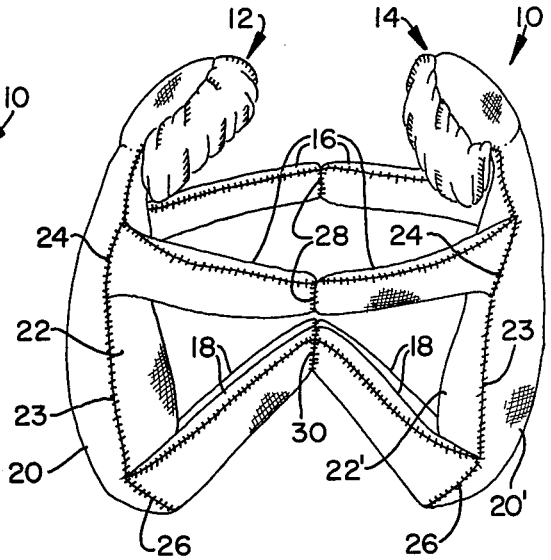
FIG. 3 discloses still another configuration of the dolls seen disclosed in FIGS. 1 and 2.
Figure 4:
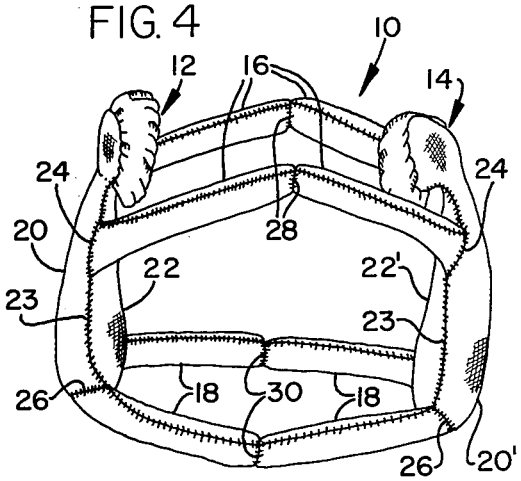
FIG. 4 discloses the dolls of the present invention disposed in still another different configuration.
Figure 5:
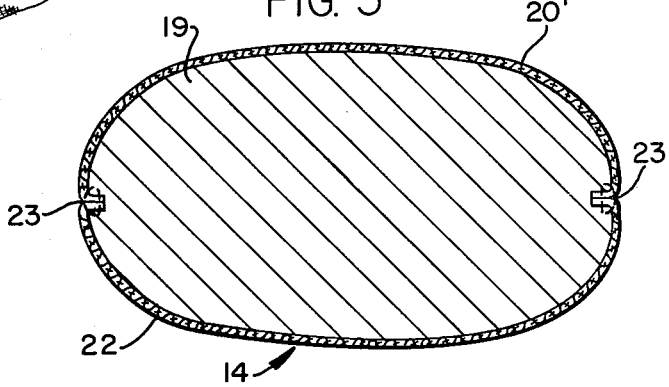
FIG. 5 is an enlarged, cross-sectional view taken along line 5—5 of FIG. 1.

In FIGS. 1–5, the assembled dolls 10 of the first embodiment of this invention comprise a first rag doll 12 and a second rag doll 14. Each of the dolls is provided with arms 16 and legs 18. As seen in the illustration of FIG. 5, the dolls contain stuffing 19, which distends the outer covering 20' to thereby simulate a torso. The head, arms, and legs of the dolls are similarly stuffed. The stuffing can be any resilient, deformable material, such as foamed plastic, scraps of cloth, cotton wadding, mohair, wool, or any other sort of material of similar characteristics.

The dolls preferably are fabricated by cutting a first patterned half 20 and a second patterned half 22, so that the two halves may be joined together by stitching at 23.

The arms are stitched to the torso at 24, while the legs are stitched to the torso at 26.

The interconnection between the dolls is effected by stitching or sewing at 28 and 30 in such a manner to provide a joint so that the contiguous legs and arms are articulated relative to one another.

Those skilled in the art of sewing will realize that the torso, arms, and legs must be turned "right side out" prior to effecting the stitching at 28 and 30. Moreover, for ease in fabricating the dolls, the individual legs, arms, and torso should be turned right side out and stuffed before the component parts thereof are assembled into a final, unitary structure.

Figure 2:
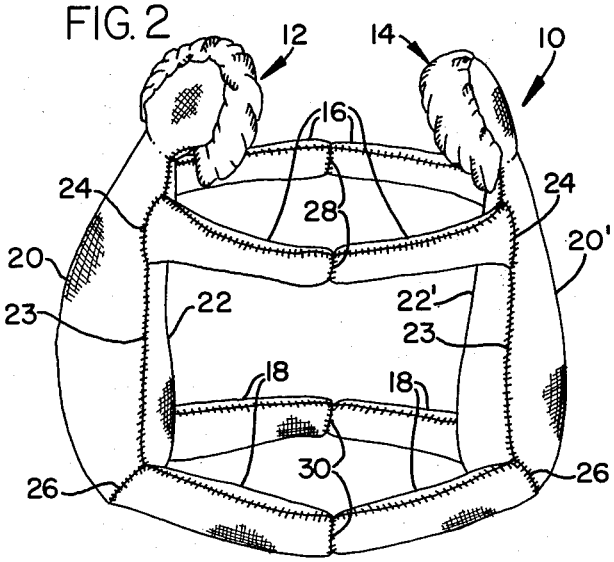
FIG. 2 is an illustration of a pair of rag dolls made in accordance with the present invention, with the dolls being shown in a configuration different from FIG. 1.

In operation, the joined-together, stuffed rag dolls may be placed in an infinite number of different positions, and each different position imparts different characteristics into the pair of rag dolls. A limited number of these different configurations or positions are seen illustrated in FIGS. 1–4. In FIG. 2, one of the dolls appears to have an inquisitive expression, while the remaining doll has a very studious expression involving profound concentration. In FIG. 3, the dolls appear to be a bit mournful, because their heads are downcast and they appear to be attempting to console one another. In FIG. 4, perhaps the dolls have overcome their mutual or individual problems, because they appear to be somewhat exhilarated The dolls can be laid across one's arm to provide a most attractive adornment, or slung across one's shoulder, or one can place an arm between the contiguous dolls, with the stomach area of one doll resting on the arm. Accordingly, the rag dolls of the present invention provide tremendous entertainment during fabrication, and thereafter provide endless amusement as they are placed into each of the never-ending different possible configurations.

Figure 6:
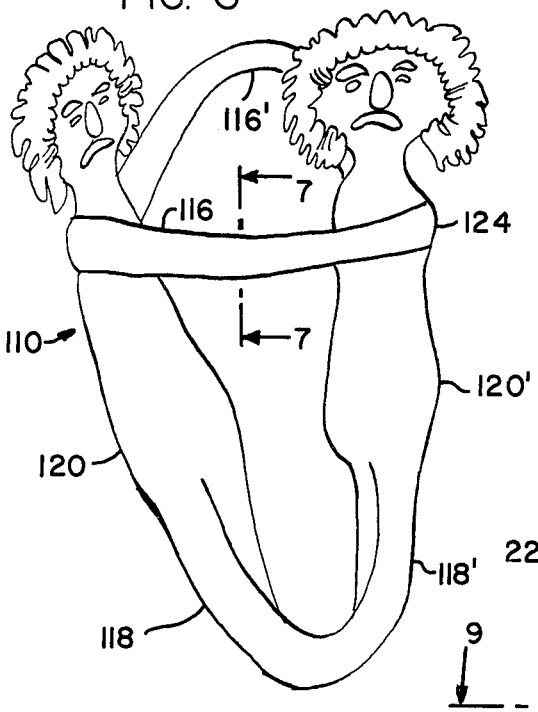
FIG. 6 is a perspective view of a pair of dolls made in accordance with a second embodiment of the present invention.

In the embodiment of FIG. 6, the assembled dolls 110 of the invention comprise a first and second doll having arms 116, 116' and legs 118, 118'. Numeral 120 indicates the outer surface of the torso of the first doll, while numeral 120' indicates the outer surface of the torso of the second doll.

Figure 7:
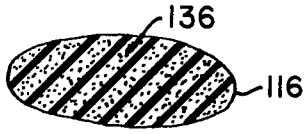
FIG. 7 is an enlarged, cross-sectional view taken along line 7—7 of FIG. 6.

As seen illustrated in FIG. 7, the dolls are comprised of a solid body of foam material 136 throughout the torso, arms, and legs of the doll. The arms 116 join the shoulders of the first and second dolls together, with there being no articulated joints in the arms. The legs are likewise continuous and join the lower extremity of the torsos of the first and second dolls together. In this embodiment of the invention, the foam rubber preferably is integral throughout the doll structure, with there being no connecting joints in the leg members 118, 118'.

Figure 8:
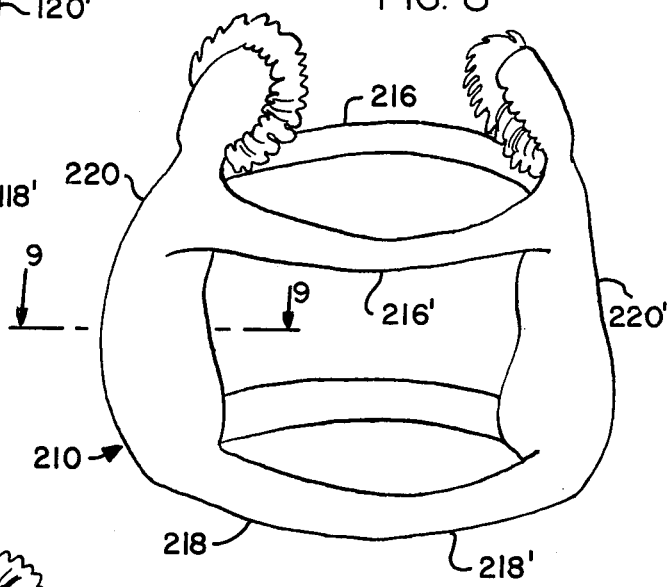
FIG. 8 is a perspective view of a pair of dolls made in accordance with another embodiment of the present invention.

In the embodiment disclosed in FIG. 8, the first doll 220 is joined to the second doll 220' by the illustrated arms 216 and 216' and the illustrated legs 218 and 218'. The arms and legs have no joints.

Figure 9:
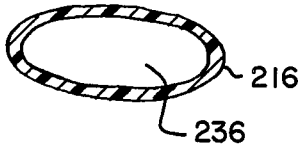
FIG. 9 is a cross-sectional view taken along line 9—9 of FIG. 8.

As seen in the illustration of FIG. 9, the torso, arms, and legs are comprised of a hollow body member such as broadly disclosed in FIG. 9. The material of construction used in fabricating the dolls preferably is a resilient, self-supporting plastic 216 having a void 236. Hence the hollow arms and legs communicate the hollow interior of the first and second dolls with one another.

Figure 10:
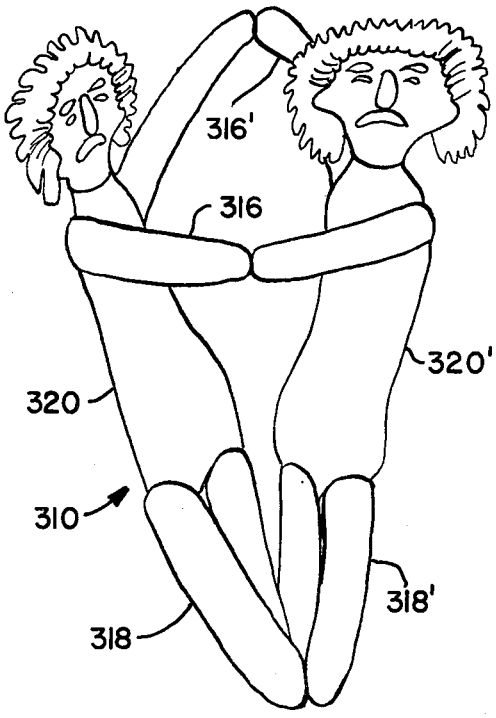
FIG. 10 is a perspective view of a pair of dolls made in accordance with still another embodiment of the present invention.
Figure 11:
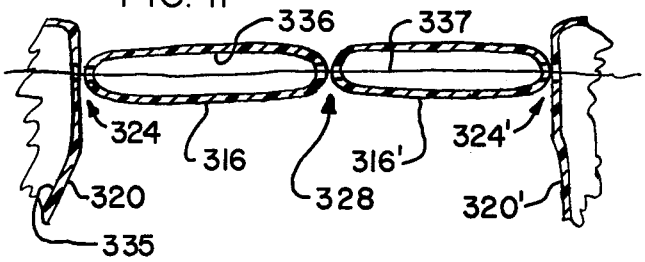
FIG. 11 is a cross-sectional detail taken longitudinally through the arms of the embodiment of the invention disclosed in FIG. 10; and, FIG. 12 is an enlarged, fragmented, detail of a modification of the foregoing embodiment of the present invention.

In the embodiment disclosed in FIG. 10, the assembled dolls 310 are comprised of a first doll 320 and a second doll 320'. The dolls are joined together in face-to-face relationship by the illustrated arms 316 and 316', and the illustrated legs 318 and 318'. As seen illustrated in FIGS. 11 and 12, the first doll 320 is joined at 324 by an arm 316; while the doll 320' is joined at 324' to arm 316'.

The interior of the torsos of the embodiment of the invention disclosed in FIG. 10 can be made hollow, as indicated at 335, with the torso being formed by self-supporting plastic material, as for example, PVC. The interior 336 of the arms can likewise be made hollow. The individual arms and legs of the pair of dolls preferably are joined together by an elastic or stretchable string or cord 337 by continuously looping the string through the illustrated apertures formed at the shoulder and the extremities of the arms. The legs can be joined to the torso and to one another in a similar manner.

Figure 12:
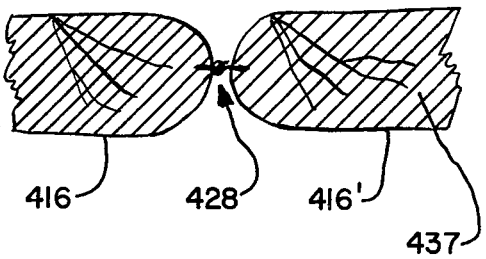

In the embodiment of FIG. 12, it will be noted that the arms and legs may be made solid, as for example, of wood, and joined together at the extremities thereof. A threaded, bendable, elongated, metallic, wire-like screw member is secured to the ends of the arms and twisted back upon itself to form the illustrated hinge at 428.

The joined-together foam rubber or plastic dolls of FIG. 6 may be placed into an infinite number of different positions, and each different position will impart a different characteristic into the pair of foam rubber dolls.

The embodiment of FIG. 6 is similar in appearance to the embodiment of FIG. 6. The hollow pair of dolls illustrated in FIG. 8 are lightweight and inexpensive and may likewise be placed in an infinite number of different positions in a manner similar to the foregoing embodiments of the invention.

In the embodiment of FIG. 10, the pair of dolls are provided with individual components comprised of the torso, head, arms, and legs. The dolls may be moved into a number of different positions respective to one another by manipulating the arms and legs and torso of the dolls so that the assembled pair of dolls take on any number of different characteristics.

I claim:

1. A pair of joined rag dolls, each of said dolls having a torso, head, arms, and legs; means, including sewing, by which said arms are joined to said torso to provide relative movement at a location where the arms and torso are interconnected;

means, including stitching, by which said legs are joined to said torso to provide relative movement at a location where the legs and torso are interconnected;

said dolls are arranged in face-to-face relationship to provide for immediacy of said dolls; with there being but two of said dolls;

the extremities of said legs being interconnected by sewing to provide relative movement along the interconnected legs; and, the extremities of said arms being interconnected by sewing to provide relative movement along the interconnected arms;

said dolls are stuffed rag dolls with said legs and arms being formed by a covering which is sewed to provide an interior which can be stuffed with rag-like material.

2. A plurality of dolls, each of said dolls having a torso, head, arms, and legs; means by which said arms are joined to said torso to provide relative movement where the arms and torso are interconnected;

means by which said legs are joined to said torso to provide relative movement where the legs and torso are interconnected;

means by which the extremities of the legs of one doll are permanently interconnected to the extremities of the legs of another doll to provide relative movement between the interconnected legs; and, means by which the extremities of the arms of one doll are permanently interconnected to the extremities of the arms of another doll to provide relative movement between the interconnected arms; said dolls having an outer pliable covering filled with a deformable material to distend said covering.

3. The dolls of claim 2 wherein said dolls are arranged in face-to-face relationship to provide for immediacy of said dolls.

4. Two facing, immediate stuffed rag dolls; each of said dolls having a torso, arms, and legs; said arms and legs of each doll being connected to and extending from said torso; said dolls being joined together by sewing at the extremity of said legs and arms by stitching the extremities of the arms of one doll to the extremities of the arms of the other doll, and by stitching the extremities of the legs of one doll to the extremities of the legs of the other doll, so that the dolls are bendable and may be placed into a number of different configurations;

the outermost surface of the dolls is a covering of fabric material, there being a resilient, rag-like material contained within the fabric covering to distend the covering; and means related to a caricature forming a head of each of the dolls.

* * * * *